United States Patent [19]

Rodgers

[11] Patent Number: 4,679,786

[45] Date of Patent: Jul. 14, 1987

[54] UNIVERSAL EXERCISE MACHINE

[76] Inventor: Robert E. Rodgers, 8011 Meadow Croft, Houston, Tex. 77063

[21] Appl. No.: 832,640

[22] Filed: Feb. 25, 1986

[51] Int. Cl.[4] ..... A63B 21/00; A63B 1/00

[52] U.S. Cl. ..... 272/70; 272/97; 272/69; 272/72

[58] Field of Search ..... 272/70, 72, 97, 69, 272/126, 93, 134, 73, DIG. 4, DIG. 2, 132; 128/25 R

[56] References Cited

U.S. PATENT DOCUMENTS

| | | | |
|---|---|---|---|
| 3,572,700 | 3/1971 | Mastropaolo | 272/132 X |
| 3,582,069 | 6/1971 | Flick | 272/126 |
| 3,592,466 | 7/1971 | Parsons | 272/69 |
| 4,488,719 | 12/1984 | Brown et al. | 272/72 |
| 4,512,571 | 4/1985 | Hermelin | 272/126 |
| 4,519,604 | 5/1985 | Arzounian | 272/73 |
| 4,529,194 | 7/1985 | Haaheim | 272/69 |
| 4,550,908 | 11/1985 | Dixon | 272/130 |
| 4,618,139 | 10/1986 | Haaheim | 272/70 |

*Primary Examiner*—Richard J. Apley
*Assistant Examiner*—S. R. Crow
*Attorney, Agent, or Firm*—Gunn, Lee & Jackson

[57] ABSTRACT

In an exercise device having an elongate frame, a user can exercise by engaging four slides, one for each limb. The slides travel along parallel paths, enabling reciprocating motion. Each slide connects to a chain or cable segment to enable reciprocating cable motion. The motion is coupled to elongate cables (one or more) which connect to gears, causing reciprocation of clutches, thereby impulsing a fly wheel in a single direction and causing rotation.

18 Claims, 16 Drawing Figures

FIG. 6
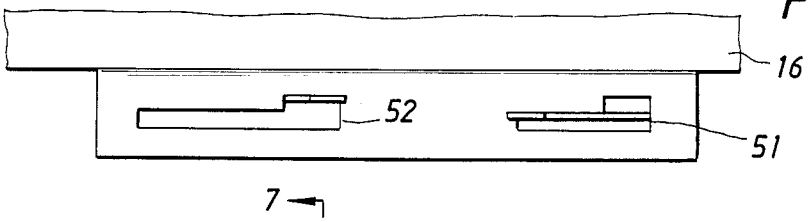
FIG. 7
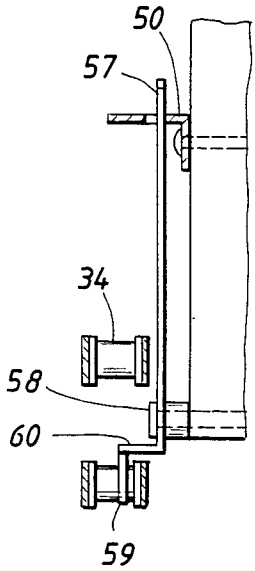
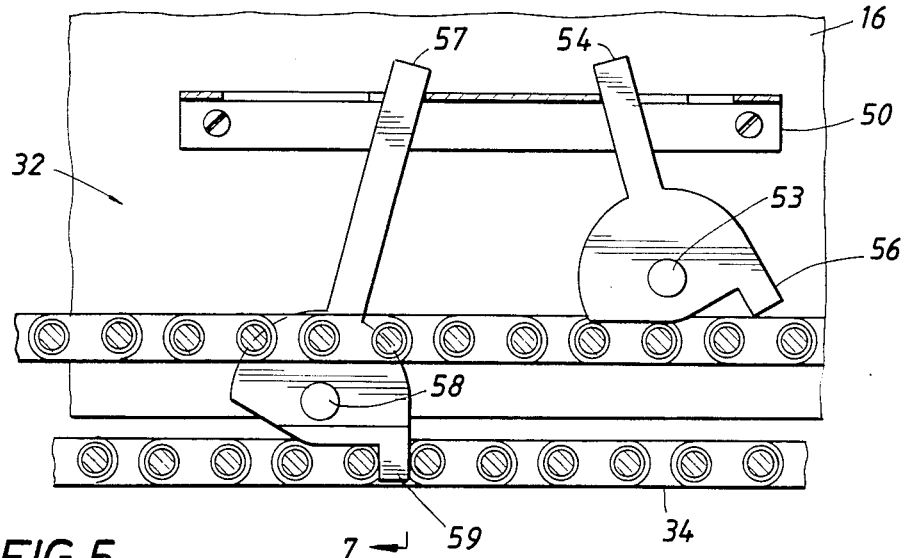
FIG. 5
FIG. 8
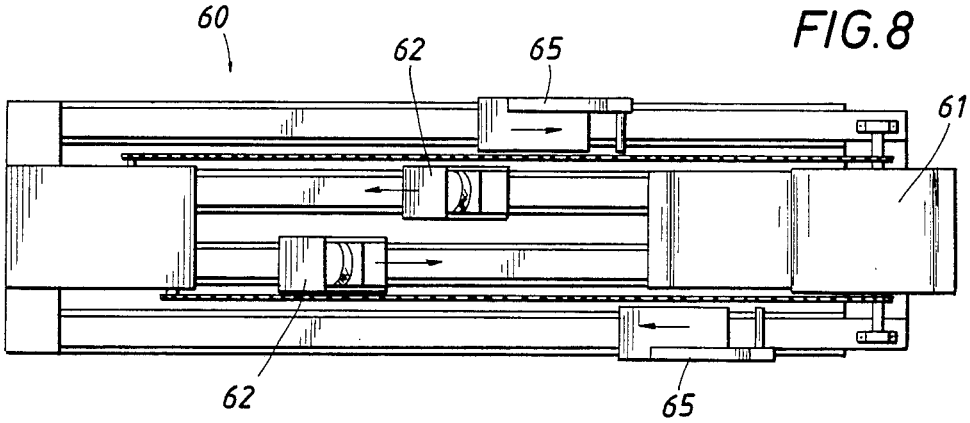
FIG. 9
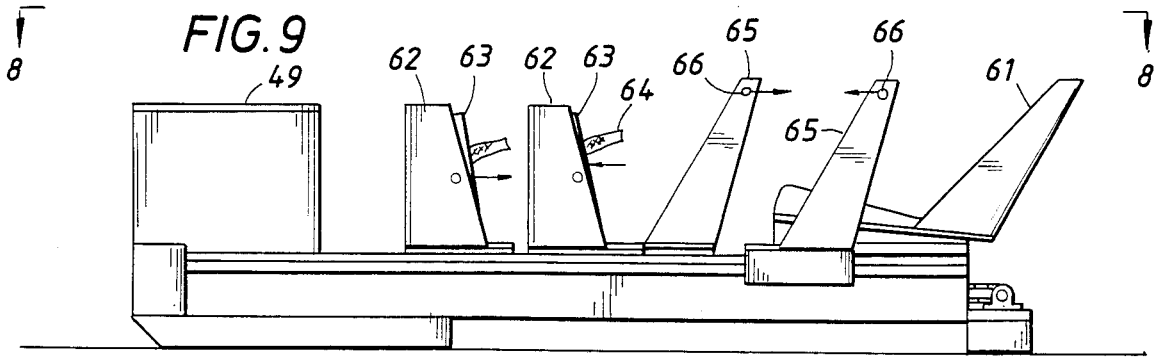

UNIVERSAL EXERCISE MACHINE

BACKGROUND OF THE INVENTION

This apparatus is directed to a universal exercise machine. This is a device which a user can engage thereby obtaining exercise of both legs in one mode of use and alternatively exercising both legs and both arms simultaneously. It enables the user to execute a variety of strokes, thereby accomplishing many vigorous types of exercise. Machines or other devices of a general nature similar to this include those set forth in U.S. Pat. Nos. 3,528,653, 3,572,700, and 4,470,597. These are devices which feature endless cable systems rigged to operate in such a fashion that power from the user is somehow or in some fashion dissipated. The present disclosure sets forth a track operated multi-pedal system. It incorporates what might be termed as four moving slides or pedals. They can be rigged to support the user's feet or alternatively they can be attached to various hand-hold devices with a view of imparting arm powered movement to the machine. The slides are arranged on a board or frame member, the slides operatively connected with chains or belts therebelow. Several chains, belts, or cables are deployed in the fashion of an endless loop, and the endless loop in turn collaborates with a clutching mechanism to be described which permits the reciprocated endless loop to drive a power dissipating mechanism.

In general terms, the apparatus of the present disclosure is an adaptive device which can be used to simulate various and sundry types of movements. One type of movement utilizes a fixed seat and thereby provides a simulated form of bicycling exercise. Another arrangement utilizes a sliding seat and thereby provides a simulated form of rowing exercise. Another arrangement can be utilized to simulate a skiing motion involving both legs and arms, thereby providing an exercise device which exercises all limbs of the user.

DETAILED DESCRIPTIONS OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 5 is an enlarged detailed view of a chain latch mechanism to connect a movable slide with an endless chain;

FIG. 6 is a top or plan view of the structure shown in FIG. 5;

FIG. 7 is a sectional view taken along the line 7—7 of the structure shown in FIG. 5 showing how the slide connects with the upper or lower endless chain;

FIG. 8 is a detailed view of the structure shown in FIG. 1 modified to include a seat and foot supports for simulating a bicycling machine;

FIG. 9 is a side view of the structure shown in FIG. 8 illustrating additional details of the seat mechanism and foot supports for engaging hands and legs;

DETAILED DESCRIPTION OF THE PREFERRED EMBODIMENTS

Figure 1:
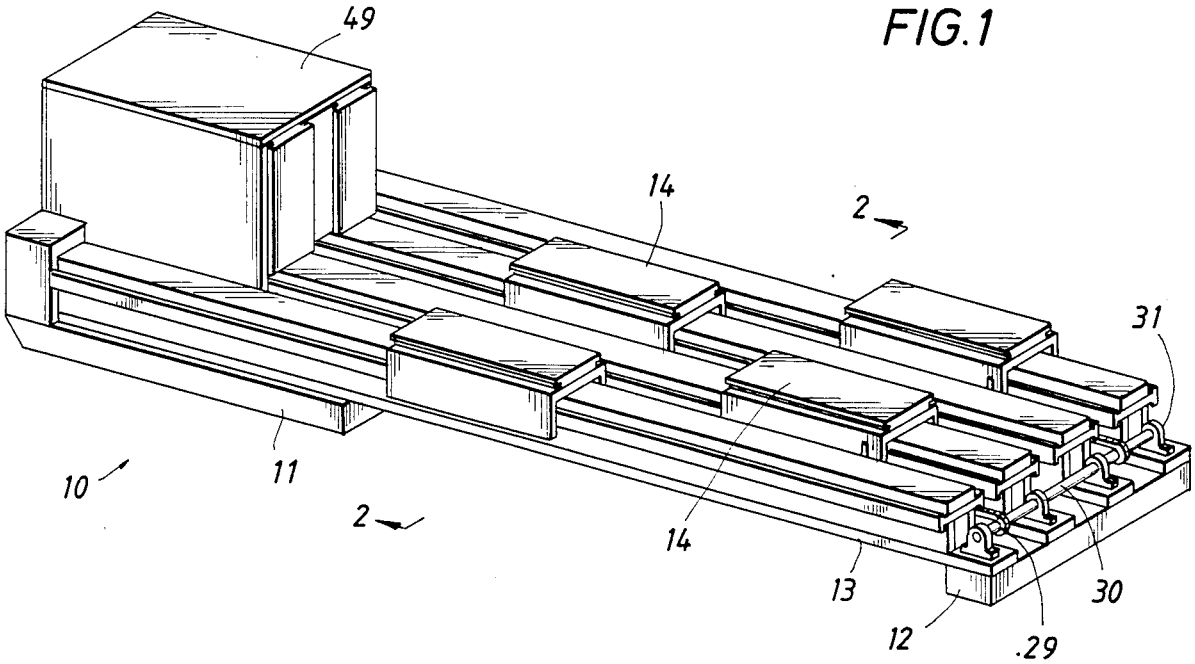
FIG. 1 is an isometric view of the universal exercise device of this this disclosure showing four slides placed thereon for engagement by the four limbs of the user to obtain different exercise motions.
Figure 2:
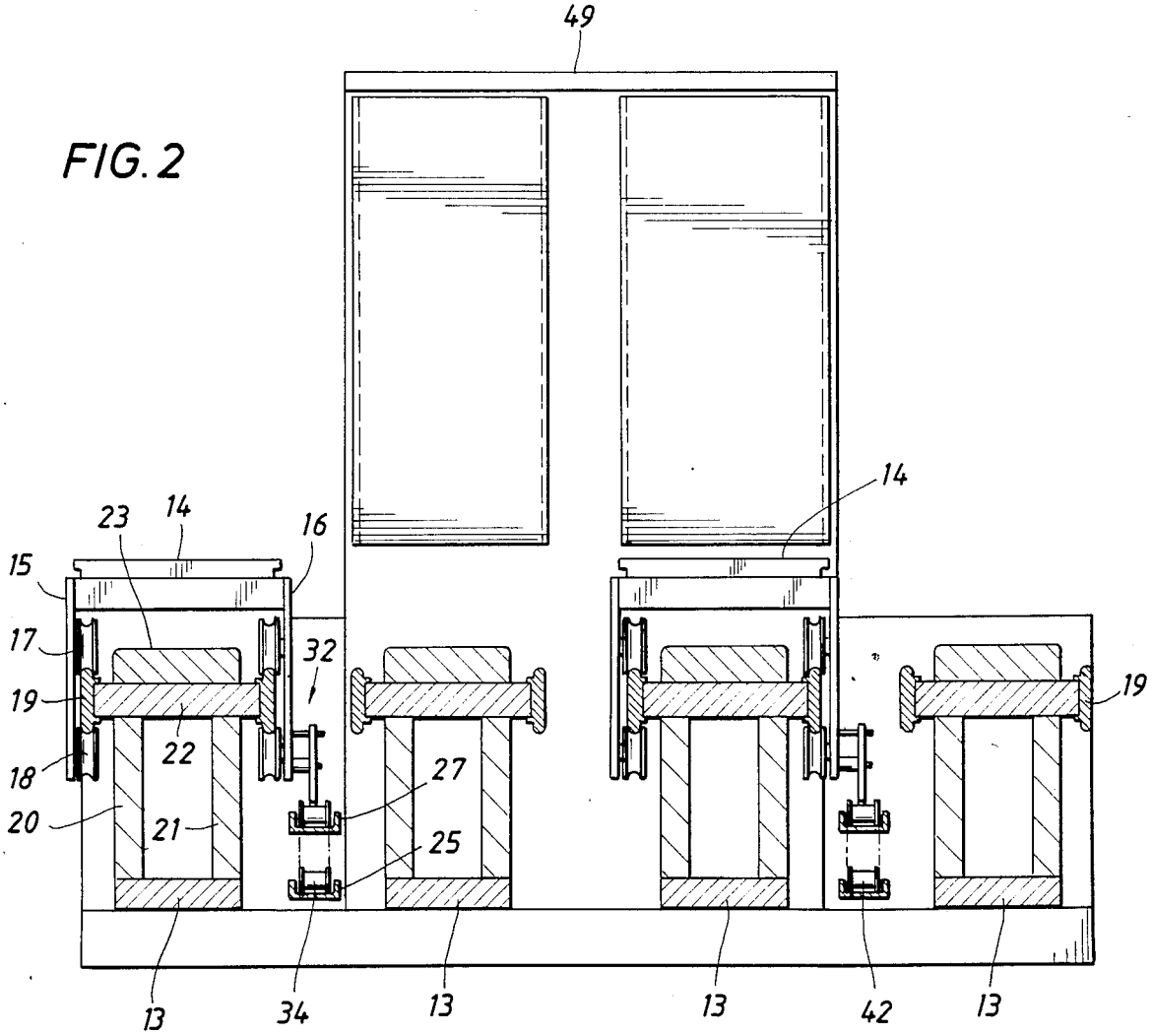
FIG. 2 is a view along the line 2—2 of FIG. 1 showing internal details of construction of the various slides and chains beneath the slides enabling connection to an endless chains system.

Directing attention to FIGS. 1 and 2 jointly, a universal exercise device is identified by the numeral 10. It incorporates a base 11 adapted to rest on the floor, the base 11 supporting the one end of the structure while a similar spaced base member 12 supports the opposite end of the structure. The structure is constructed with a number of lengthwise frame members 13. The frame members can be solid or several parallel members; the frame members 13 define the major dimension of the device and thereby support the various rails, slides and endless chains to be described. The frame members 13 are also shown in sectional view, thereby defining a support for individual slides to be described.

In FIG. 2, an individual slide is identified by the numeral 14. It is replicated at four places on the device 10. The slide 14 includes an inverted u-shaped structure. It has a pair of downwardly protruding side plates 15 and 16. The side plates support rollers 17 and 18 in spaced arrangement to achieve clamping action above and below a guide rail 19. The guide rail is duplicated on both sides; that is, there are rollers and guide rail for both sides of the side plates 15 and 16. The guide rail 19 is fixed parallel to an upstanding rectangular frame member which extends the full length of the equipment. The frame member includes upstanding structural members 20 and 21 standing parallel to one another and supporting a transverse frame member 22. The four frame members define a rectangle which extends the full length of the apparatus from one end to the other. The rectangular frame member is covered with a top plate 23 for structural reinforcing. While the rectangular frame member shown is made of multiple pieces, it can also be formed of extruded stock, and can be made of metal, plastic or wood. The guide rail 19 is shown to have a cross section which is an oval, but a tubular member of different profile can be used provided it defines tracks or engaging race ways for the rollers 17 and 18. The rollers have a concave outer face to enable positive locking of the rollers to the guide rail 19; this prevents lateral shifting to the left or to the right.

The typical slide is preferably constructed with eight rollers, four on each side so that the slide 14 is stabilized by roller contact at fore and aft ends thereof. This assures smooth movement. The load which is placed on the slide 14 is transferred through rollers to the conforming tubular member 19. In turn, that is held rigidly by the supporting rectangular frame work above the frame member 13.

An elongate tray 25 is fixed to base members 11 and 12. The tray 25 supports a link chain which is formed in an endless loop. The link chain travels in the tray which prevents wobble in the chain. The chain makes two passes, being defined as an endless loop, and therefore a second tray 27 also supports the chain. The two trays are parallel and spaced one above the other. The endless loop link chain extends to a sprocket 29 shown in FIG. 1. The sprocket is supported on a shaft 30 for free wheeling rotation. The shaft 30 in turn is held in position by suitable set of pillow blocks 31. The shaft 30 is perpendicular to the chain and is deployed so that the multiple chains in the apparatus extend parallel to one another along the length of the equipment.

Returning to FIG. 2, the slide 14 is duplicated at four locations, therebeing four parallel tracks. The two slides on the left are supported for connection with the chain on the left. Connection between the slides and the chain is obtained by apparatus better illustrated in FIGS. 5–7 to be described. Thus, the slide 14 at the left hand edge of FIG. 2 is equipped with a connecting means 32 located above the chain. The track to the inside of that slide is constructed for a left side connecting means 32. The structures shown in FIGS. 5–7 are identical, one being provided for each slide, and they are readily placed on the side plates 15 or 16 (as required) to enable two slides to engage a single linked chain. Each slide could be provided with its own link chain, but economies of construction can be obtained by reducing the number of chains in the associated apparatus.

In summary as described to this juncture, there are four slides for the four limbs of the user, and they travel on four parallel tracks. The two slides on the left engage the chain on the left, while the two slides on the right engage the chain on the right.

Figure 3:
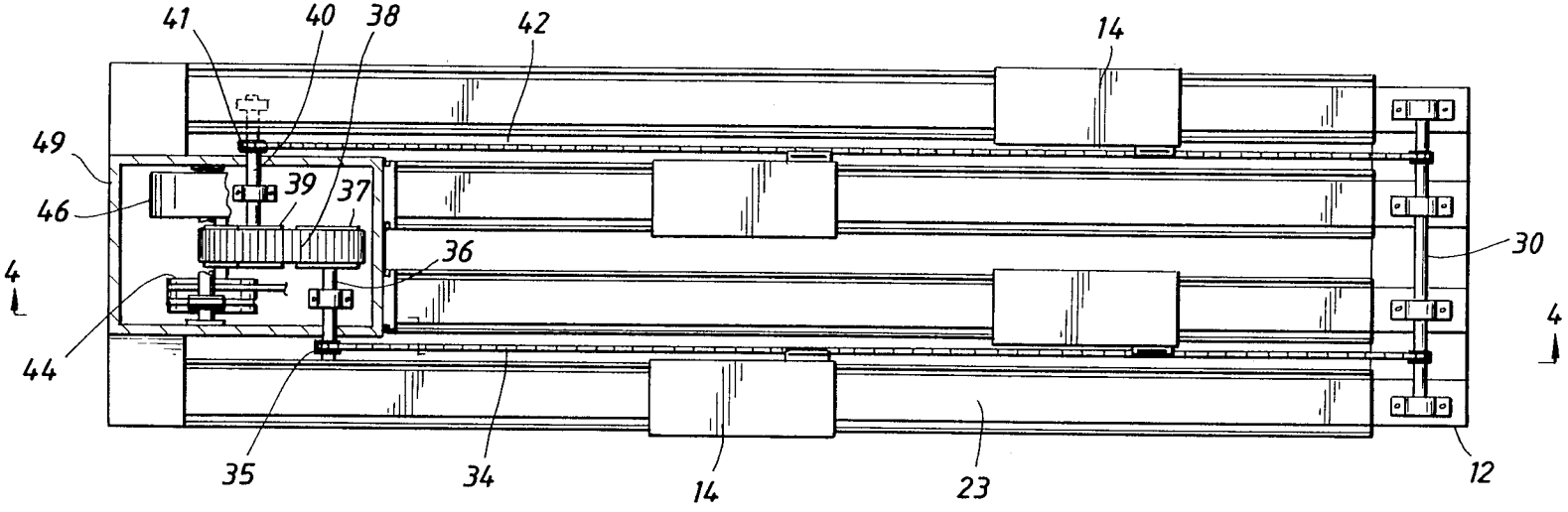
FIG. 3 is a top view of the structure shown in FIG. 1 with a portion of the cover broken away to show details of construction of a power dissipating mechanism.
Figure 4:
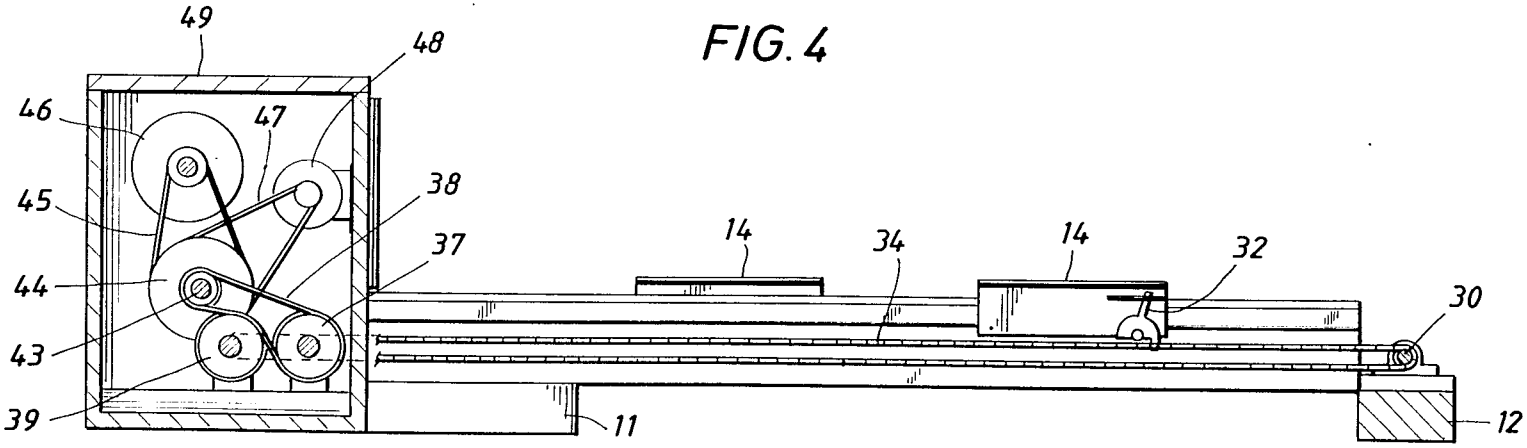
FIG. 4 is a sectional view taken along the line 4—4 of FIG. 3 showing details of construction of the endless chain located beneath the slides to permit reciprocating motion.

Going now to FIGS. 3 and 4 jointly, the endless link chain is identified by the numeral 34. It extends to a driven link chain sprocket 35 supported on a short shaft 36. The shaft 36 (supported by appropriate pillow blocks for alignment) connects to an overrunning clutch 37. The clutch 37 in turn engages a belt drive 38. The belt drive 38 engages a second overrunning clutch 39. The clutch 39 is supported on a shaft 40. The shaft 40 supports a driven sprocket 41 for engaging the second chain 42. For convenience sake, the two chains are different length so that the two shafts driven by them are located at different locations. In other words, they are not on a common line. The two shafts drive the two overrunning clutches 37 and 39. In turn, these clutches are engaged by a common belt drive 38. The belt drive 38 extends upwardly to drive a pulley 43 shown in FIG. 4 which in turn rotates a larger pulley 44. The pulley 44 engages two belt drives. A first belt 45 extends upwardly to a large fly wheel 46. The fly wheel 46 is supported on a suitable stub shaft. In addition, a belt drive 47 extends upwardly to a power dissipating device such as a generator 48. This can be switched on or off to vary the amount of power required by the user. Indeed, if adjustment over a wide range is required, the generator 48 can be connected with a suitable adjustable resistor load bank to thereby consume differing levels of electrical power. This enables the load to be varied depending on the strength and physical condition of the user. For light workouts, the electric generator 48 can be switched off and the user can then power the fly wheel. For increased drag, the electric generator 48 can be operatively connected to a suitable resistor load bank. As the current generated by the electric generator is varied, the load experienced by the user is varied in relation to the current. As will be understood all of the apparatus including the various drives, belts and clutches is enclosed within a suitable housing identified generally at 49. The housing is shown with a portion broken away in FIG. 3 to show details of construction. As will be further understood, FIG. 3 shows certain of the component broken away to provide details of constructio of the components located in the lower portions of the closed housing 49.

Directing attention to FIG. 5 of the drawings, the means 32 is shown in greater detail. There, the endless link chain 34 is shown moving along two paths, the upper portion traveling in one direction and the lower portion traveling in the other direction. As shown in FIG. 5 the sidewall 16 supports an angle bracket 50 affixed to it by suitable screws or bolts. The angle bracket 50 has a protruding flange better shown in FIG. 6 which has an L-shaped cutout 51 placed in it. There is a similar L-shaped cutout 52 at the opposite end of the member 50. They are similar and differ in length. As shown in the side view of FIG. 5, a latch mechanism is supported on a pivot shaft 53 and is rotated by means of an upstanding lever 54. The lever extends into the L-shaped slot 51. This is in the unlocked position as shown in FIG. 5; rotation in a clockwise direction viewed in FIG. 5 moves it to a locked position. In the unlocked position, a lock tab 56 is retracted away from the chain. When rotation occurs, the tab 56 points downwardly into the chain and past adjacent link of the chains to lock into the chain. Perhaps this is better understood on viewing the similar equipment to the left. The equipment on the left differs in that the handle 57 is longer. This enables the pivot 58 be located lower in the structure to engage the lower chain. This handle 57 is also operated in the same fashion by rotating in the clockwise direction to achieve locking whereby the downwardly protruding tab 59 extends between links in the chain. The tab 56 extends vertically downwardly into the chain to lock into the chain.

FIG. 7 shows the tab 59 off-set laterally by a lateral projecting member 60. As will be appreciated, only one of the two latch mechanisms is engaged at any one moment. If the upper one is engaged, a power stroke applied to the chain moves in one direction; if the other of the two latch means is engaged, the power stroke is in the opposite direction. This enables the user to switch the power strokes directions for the slide. So that this will be clearly understood, it will be recalled that the chain 34 reciprocates to and fro. It reciprocates back and forth, one stroke being under power and the other stroke being a return or free wheeling stroke. This is accomplished by means of the over running clutches which were included in the structure as will be described in detail hereinafter.

Going now to FIGS. 8 and 9 jointly, an alternate embodiment is identified by the numeral 60. It is a type of bicycling machine with arm exercisers. It includes a seat 61 having an upstanding back and bottom cushion. The seat is anchored at the far right hand end of the equipment. It is placed on the two center rails. That is, it does not need to span the full width of the equipment. It is located so that the seat 61 anchors to provide a fixed rest position for the user. Recalling that there are four slides arranged parallel to one another, the two in the middle are modified to include foot supports. One foot support is shown at an extended position in FIG. 9 and is identified by the numeral 62. The other foot support is identical and is therefore identified by the numeral 62. They differ in location to indicate reciprocation of the two foot supports. They are preferably upstanding and include a sole plate 63 with a fastening strap 64 to hook over the foot. Thus, duplicate devices are provided for both feet of the user.

The numeral 65 identifies a hand engaged support affixed to the outboard slide. Again, as shown in FIG. 8, there are two deployed along the marginal edges of the device. They are able to slide back and forth driving the link chains. The members 65 extend upwardly to a suitable height to be comfortable for the user, and they support hand grips 66 which extend horizontally to be held by the user. As shown by the direction in the arrows in FIGS. 8 and 9 jointly, it will thus be seen that the left arm and left leg move in opposite directions. The same is true of the right arm and leg. A very comfortable bicycling motion with arms exercise can be obtained by this arrangement. User comfort is achieved by the shape and angle of the seat 61. It is also achieved by rotation of the sole plate 63. That is adjusted so that the user is able to rest his foot on the sole plate and obtain the proper tilt or rotation. In like fashion, the hand supports 66 are placed a suitable elevation to enable comfortable use. More will be noted regarding operation of the device hereinafter.

Figure 10:
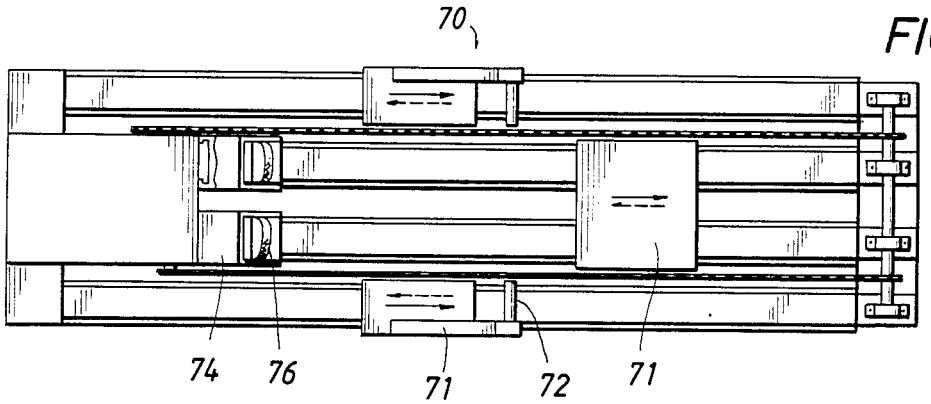
FIG. 10 is a top view of the universal exercise device using only two slides and a movable seat to provide a form of rowing apparatus.
Figure 11:
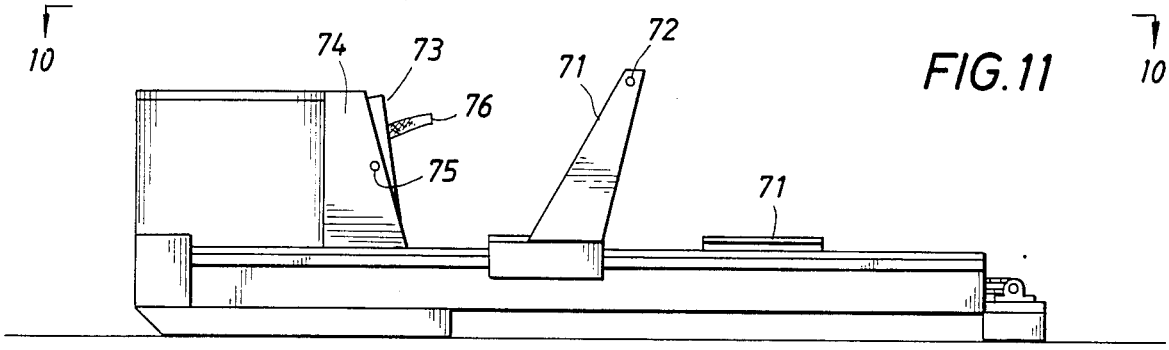
FIG. 11 is a side view of the structure in FIG. 10.

Another embodiment is shown in FIGS. 10 and 11 considered jointly and is identified by the numeral 70. This embodiment uses a seat 71 affixed to the two middle slides which are disengaged from the chain. The outer slides are equipped with hand supports similar to those shown in FIG. 9 at 65. The hand support is thus identified by the numeral 71 in FIG. 11 and again incorporates a horizontal hand grip 72. Both feet are placed on appropriate sole plates 73 which are supported in a suitable housing 74. The sole plate 73 rotates about a shaft 75 and engages one foot of the user with loop 76. Thus, both feet are pressed against the respective sole plates and the user's hands work the outboard slides in unison while the seat slides freely.

Figure 12:
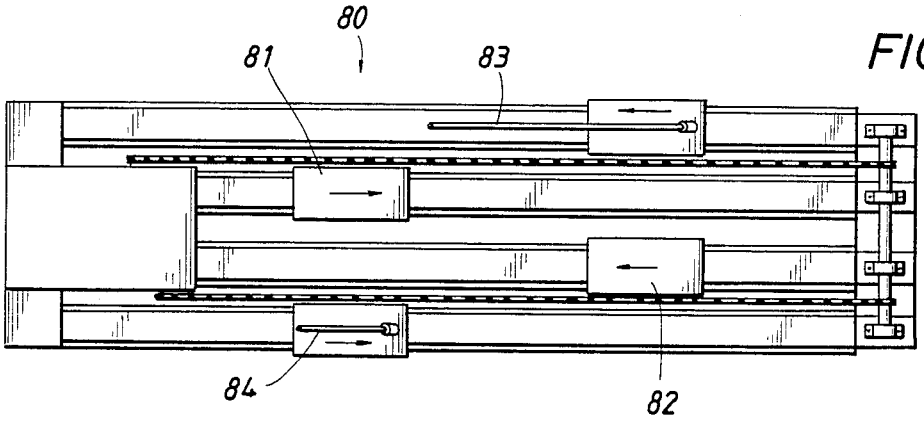
FIG. 12 shows another embodiment of the apparatus rigged to simulate skiing motion whereby a different form of exercise can be obtained, FIG. 12 being a plan view.
Figure 13:
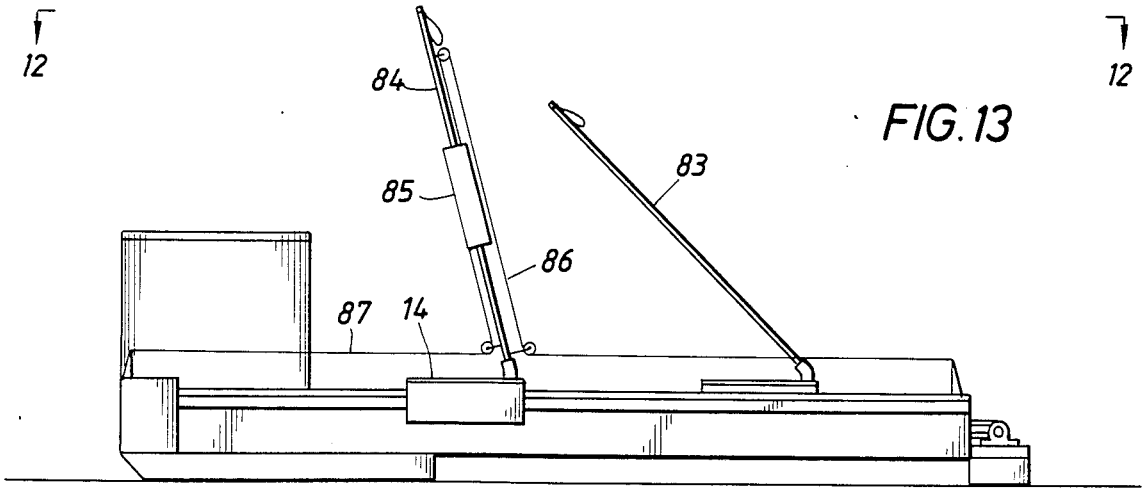
FIG. 13 is a side view of the structure in FIG. 12.

Attention is directed to the embodiment 80 shown in FIGS. 12 and 13. This construction provides a simulated skiing motion. Briefly, the slides 81 and 82 reciprocate under foot power by the user standing erect on the two middle slides. The user is then able to grasp simulated ski poles 83 and 84. The ski poles 83 and 84 connect to the outboard slides.

Regarding operation of the embodiments 10, 60, 70 and 80, attention is momentarily directed to the means 32 best shown in FIG. 5. This is adjusted to make suitable connections with the link chain 34. Since there are four slides, each slide is connected to a link chain and thus, the tabs are inserted or removed at the user's choice. Once this has been accomplished, a selected mode course of operation is then pursued. Assume for purposes of discussion that suitable slides are connected to the two link chains to provide reciprocating driving power. In other words, each link chain is provided with a power stroke, (furnished either by arm or leg) and has a return stroke which is not under power. This type of arrangement is achieved by making the operative connections utilizing the means 32 to thereby join the four slides to the link chains. If fewer than four slides are connected, the device will still operate in a very acceptable manner for the user. The user then begins to exercise by providing reciprocating motion via his arms or legs in an exercising stroke or move, thereby imparting reciprocating driving motion to the two link chains. Considering FIG. 4 now, the means 32 is shown latched to connect the slide to the chain. It is then driven with a power stroke in one direction and there is a return stroke in the opposite direction. Assume when viewing FIG. 4 that the power stroke is to the left. This forces the slide 14 towards the housing 49. Power is delivered to the link chain 34 through the sprocket 35, shaft 36, and over running clutch 37. The clutch 37 powers the belt drive 38. This belt drive engages the over running clutch and is thus provided with power only on the power stroke. On the return stroke of the slide 14, the over running clutch 37 free wheels permitting the chain 34 to be retracted, thereby returning the slide to the beginning position. This back and forth motion accomplishes power transfer from the user through the slide then through the chain and the overrunning clutch 37. This power is then delivered to the pulleys at 44 shown in FIG. 4. Power is applied from there to the fly wheel 46. The fly wheel 46 is brought up to some kind of speed by the continual stroking of the slide, the speed establishing an operating rate for the system. As will be understood, overcoming inertia of the fly wheel 46 provides some resistance to the user as he moves the equipment up to a designated speed or velocity. In addition to this work accomplished at start up, the pulley 44 is engaged with the electric generator 48 to thereby generate electricity and consume power by the performance of the exercise. This can be adjusted to thereby vary the drag on the system.

The foregoing discusses power provided from only one chain. The other chain also provides power. Power from the second chain is delivered to the equipment through the same approach. That is, the second link chain 42 is powered by reciprocating strokes. It feeds this power through the sprocket 41, rotating the shaft 40 in reciprocating motion. The shaft is connected in the overrunning clutch 39. That clutch is powered in one stroke and free wheels as the retraction stroke occurs for the slide connected to the chain 42. The overrunning clutch 39 joins with the overrunning clutch 37 to deliver power in a continuous flow to the belt drive 38. Power is delivered through one chain and then the other. In the ordinary operation, the user will provide power with first one leg and then the other. Thus, the user (in that sense) provides alternating power strokes.

The particular exercise mode for the user may vary. As an example, power can be furnished from first the left leg and then the right leg. This might be accomplished in the arrangement shown in FIGS. 8 and 9. Alternatively, the arm supports 65 in FIG. 8 can be connected with the chains while the slides for the feet are disconnected from the chains. That is to say, the user can place his feet on the foot rests 62 and yet deliver no power because they are disconnected to the chain by the means 32 shown in FIG. 5. This enables the user to provide all power through the arms only. Alternatively, all four slides can be connected so that the user is able to provide power through all four of the slides. Even more interestingly, as the foot slides 62 are pushed to the left as shown in FIG. 9, they can deliver power; the hand-held members 65 can be connected through the means 32 to require power of the user on the back stroke. As will be understood, the user has a variety of choices of power strokes and return strokes for the four slides. Indeed, the arrangements shown in the other views enable the user to operate four slides, or perhaps only two slides connected as shown in FIG. 10 while the user sits on a seat 71. That is, the hand supports 70 are placed on the outer slides and travel under power in both directions.

One alternative arrangement which might be incorporated is a sliding handle 85 shown in FIG. 13. This handle can be connected with a tethered line 86 which is routed to suitable pulley so that is slides up and down on the handle 84. The handle 84 thus reciprocates depending on the movement of the slide 14 along the exercise device 10. This can be duplicated on both handles. A double control line can be used including the second line 87 to move the handle 85 forcefully upwardly and downwardly on the simulated ski pole. Another alteration which can be incorporated in the present apparatus is the use of a drag brake dragging the fly wheel 46. Instead of a drag brake, a fluid dash pot can also be used to dissipate energy. A great variety of power dissipating devices can be used instead of the electric generator 48. The electric generator, though, is desirable because it can be readily connected with a watt meter to provide an indication of the actual power delivered. That can be equated to an exercise level for the user.

As will be understood from the description hereinabove relating to the several embodiments, the present apparatus particularly features four reciprocating slides guided along parallel paths by the structure. The slides are selectively connected with link chains. They are connected so they can travel with the link chains providing power strokes either in one direction or in both directions depending on the nature of the connections. This power is delivered to a power consuming fly wheel and load device. Moreover, the dual chain drive system connects with the apparatus so that recipricating stroking motion by the user is converted into reciprocating power pulses which are smoothed by the fly wheel rotating in a single direction.

Figure 14:
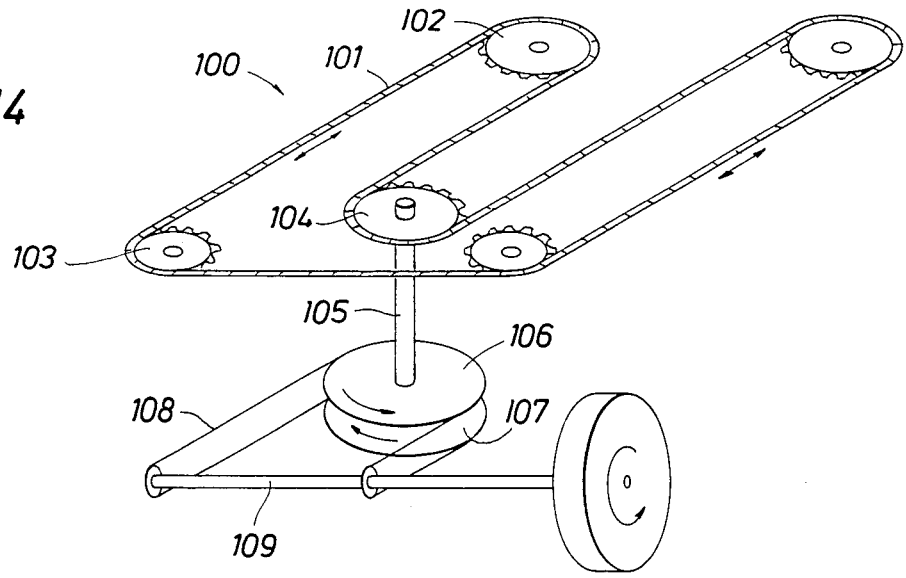
FIG. 14 is an alternate routing pattern for a drive chain enabling connection of the dry chain to four slides operated by the four limbs of the user.

Attention is now directed to FIG. 14 of the drawings. This view shows an alternate embodiment of the power transfer system. Thus, the means 100 is an alternate routing of the several cables or chains to transfer power from the user such that the power is dissipated during operation. In the embodiment 100, a link chain 101 is routed around a pulley 102 located at one end of the equipment while the opposite end of the equipment supports the idler sprocket 103. Conveniently, the sprocket 103 can be located in the housing 49 shown in FIGS. 3 and 4. That housing can also enclose the driven sprocket 104. The equipment is symmetrical in that the chain engaging sprockets 102 and 103 are duplicated. This defines four portions of the link chain which extend along the length of the equipment thereby enabling the user to connect operatively to the four portions, selectively engaging or disengaging the four slides. In operation, the sprocket 104 is reciprocated and imparts reciprocating motion to the drive shaft 105. The drive shaft 105 engages a pair of over running clutches 106 and 107. Both the over running clutches are driven in reciprocating fashion. They are deployed so that they power in opposite strokes. Thus, the two arrows shown in FIG. 14 indicated the direction in which the power stroke occurs. The over running clutches 106 and 107 engage a chain belt or cable 108. It is provided with power from both over running clutches and therefore travels in a single direction. There are two driven sprockets engaging the cable 108 and they in turn impart power to the drive shaft 109 which is connected with the fly wheel or a power consuming device such as a generator. It will be understood that the reciprocating rotational motion imparted to the two over running clutches 106 and 107 is converted into rotation of a single direction. This is accomplished with a single chain in the preferred embodiment.

Figure 15:
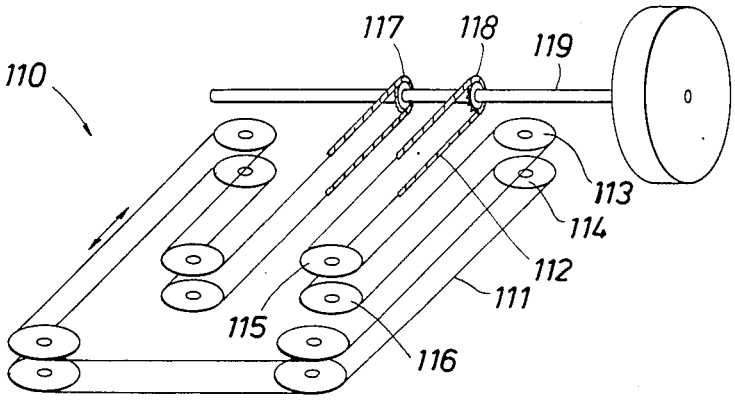
FIG. 15 is an alternate view to the arrangement shown in FIG. 14 showing another alternate deployment of the power transfer system whereby the four limbs of the user apply power.

In FIG. 15, an alternate embodiment is illustrated. The embodiment 110 utilizes an elongate cable which is cable for its full length except for two chain portions inserted. This is indicated at step 112. They are included to engage sprockets as will be described. The numerals 113 and 114 identify idler pulleys which are stacked vertically. They are opposite additional idler pulleys 115 and 116. The pulleys 113 and 115 are arranged above the pulleys 114 and 116. This routes the cabling in two planes. The location of the two planes will be mentioned hereafter. The cable extends to chain driven sprockets 117 and 118. These sprockets are positively engaged with the links of the chain. Moreover, they are deployed vertically so that the cable is located in a plane just above the two sprockets 117 and 118 and just below the two sprockets also. The two planes are parallel and are located above and below the driven shaft 119 which connects with the fly wheel. Optionally, a power consuming device can also be connected to the shaft 119. The shaft 119 is preferably located in the housing 49 of the apparatus shown in FIGS. 3 and 4. The idler pulleys 115 and 116 are located at the opposite end of the equipment.

Directing attention to the pulley 113, it will be observed that the cable 111 extends on both sides of the idler 113. This enables two slides to be connected to the cable segments extending to the idler pulley 113. This is duplicated symmetrically on the frame to thereby deploy the four slides, all the four being connected to the cable 111 for movement along four parallel paths.

Figure 16:
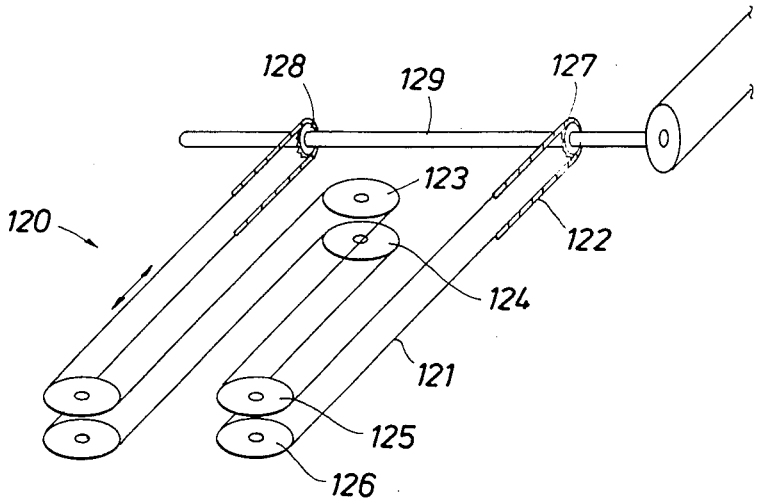
FIG. 16 shows yet another embodiment of the power transfer system including chain and cable components.

Going now to FIG. 16, another embodiment is indicated at 120. This again uses a cable 121 which has a link chain segment 122 inserted into it. Symmetrically of the cabling arrangement 120, there are upper and lower cable pulleys identified at 123 and 124. At the opposite end of the equipment, there are idler pulleys 125 and 126. The cable is equipped with two chain segments. They engage upstanding sprockets 127 and 128. In this instance, the idler pulley 125 is located above the under pulley 126. The cable is deployed so that two cable segments are located to connect with two of the slides on one side of the equipment. The equipment is symmetrical so that the remaining two slides connect with the symmetrical cable segments on the opposite sides. As before, power is imparted through the link chain segment positively engaging the chain driven sprockets 127 and 128.

In the embodiments 110 and 120, the chain driven sprockets 117, 118, 127 and 128 are chain driven around the exterior and include an over running clutch from the interior of the sprocket teeth. They are deployed so that they operate in opposite hand, comparing the sprocket pairs in each embodiment. That is, the sprocket 117 provides an over running clutch which delivers power in the direction opposite of that from the over running clutch 118. This is accomplished at both pairs of chain driven sprockets.

Each slide is guided as it travels to and fro on the supportive frame. Each slide is located vertically above two cable segments to enable a downwardly dependent cable clamp mechanism to clamp selectively around either the upper cable segment or the lower cable segment. The reversible cable clamping arrangement (see FIGS. 15 and 16) enables the user to select and clamp onto a cable segment moving one direction or the opposite with cable transfer of user movement to the fly wheel. To this end, the upper and lower cable routing shown in FIGS. 15 and 16 advantageously permits slide movement variation. as to FIG. 14 the link chain can be redily engaged in the fashion of FIGS. 5–7.

From the foregoing, it will be observed that the embodiments 100, 110 and 120 all use a single loop cable or chain or combination thereof. This single loop is routed in a somewhat more complex fashion than the routing evidenced in the other embodiments described earlier. While it is slightly more complex, it is desirable in the sense that there is only a single cable system shown in the embodiments 100, 110 and 120. For this reason, the single chain or cable system illustrates an alternate mechanism or means for routing.

While the foregoing is directed to the preferred embodiment, the scope thereof is determined by the claims which follow.

What is claimed is:

1. An exercise apparatus comprising:

(a) a supportive frame;

(b) a pair of slides mounted on said frame for reciprocating motion driven by the user during limb exercise on the exercise apparatus;

(c) first and second endless chain means deployed in loops, said first endless chain means being connected to the first of said slides, and the second of said slides being connected to the second of said endless chain means;

(d) said slides being deployed on said frame to be powered by the user in providing reciprocating motion thereto;

(e) rotative power consuming means; and (f) first means connecting said first and second endless chain means to said power consuming means for delivery of rotation thereto to deliver power to be consumed in the operation of the apparatus to thereby provide a load to the user, wherein said first means includes means powered by said endless chain means on power strokes provided by the user thereto and enabling reciprocation of said endless chain means, (g) said slides including selectively releasable chain connector means for connecting to said endless chain means to provide a power stroke in a first direction.

2. The apparatus of claim 1 including overrunning clutch means connected to said chain means for delivering power on movement of said chain means in one direction but not on movement in the opposite direction.

3. The apparatus of claim 1 wherein there are four parallel tracks supporting four separate and similar slides each of said slides including means enabling engagement with the four limbs of the user, and wherein at least two of said slides are operatively connected with said endless chain means.

4. The apparatus of claim 3 wherein all four of said slides are connected with said endless chain means, two being connected to each of said first and second endless chain means.

5. The apparatus of claim 1 including a seat means on said exercise apparatus to enable a user to sit thereon.

6. The apparatus of claim 5 including four slides on said exercise apparatus to enable a user to sit on said seat and to engage said four slides with the four limbs of the user.

7. The apparatus of claim 1 including first and second overrunning clutches, said first overrunning clutch being connected operatively to said first endless chain means and said second overrunning clutch being connected operatively to said second endless chain means, and wherein both of said of overrunning clutches operatively connect to a driven member delivering rotative power by rotation in a single direction wherein power is delivered thereto through said first and second overrunning clutches.

8. An exercise apparatus comprising:

(a) a supportive frame;

(b) a pair of slides mounted on said frame for reciprocating motion driven by the user during limb exercise on the exercise apparatus;

(c) endless chain means deployed in loops;

(d) said slides including selectively releasable chain connector means for connecting to said endless chain means to provide a power stroke in a first direction;

(e) said slides being deployed on said frame to be powered by the user in providing reciprocating motion thereto;

(f) rotative power consuming means; and (g) first means connecting said endless chain means to said power consuming means for delivery of rotation thereto to deliver power to be consumed in the operation of the apparatus to thereby provide a load to the user, wherein said first means includes means powered by said endless chain means on power strokes provided by the user thereto and enabling reciprocation of said endless chain means.

9. The apparatus of claim 8 including overrunning clutch means connected to said chain means for delivering power on movement of said chain means in one direction but not on movement in the opposite direction.

10. The apparatus of claim 8 wherein there are four parallel tracks supporting four separate and similar slides each of said slides including means enabling engagement with the four limbs of the user, and wherein at least two of said slides are operatively connected with said endless chain means.

11. The apparatus of claim 10 wherein all four of said slides are connected with said endless chain means at four locations.

12. The apparatus of claim 8 including a seat means on said exercise apparatus to enable a user to sit thereon.

13. The apparatus of claim 12 including four slides on said exercise apparatus to enable a user to sit on said seat and to engage said four slides with the four limbs of the user.

14. The apparatus of claim 8 including first and second overrunning clutches, and wherein both of said of overrunning clutches operatively connect to a driven member delivering rotative power by rotation in a single direction wherein power is delivered thereto through said first and second overrunning clutches.

15. The apparatus of claim 8 wherein said chain means is deployed along said frame with four parallel segments able to reciprocate back and forth to enable connection to four slides moving along parallel paths on said frame.

16. The apparatus of claim 15 including pulley means located at opposite ends of said frame to deploy said chain means in parallel segments.

17. The apparatus of claim 1 further including a pair of upstanding ski poles to be gripped by a user placing feet on said pair of slides wherein the user obtains ski exercise on the apparatus.

18. The apparatus of claim 17 including handles on said poles, said handles being movable relative to said frame to enable hand stroke movement approximating ski motion.

* * * * *